US006772544B2

(12) United States Patent
Takemura et al.

(10) Patent No.: US 6,772,544 B2
(45) Date of Patent: Aug. 10, 2004

(54) WHEELED WORK VEHICLE

(75) Inventors: Toshihiko Takemura, Sakai (JP); Eisaku Shinohara, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 10/390,589

(22) Filed: Mar. 17, 2003

(65) Prior Publication Data

US 2003/0226293 A1 Dec. 11, 2003

(30) Foreign Application Priority Data

Mar. 28, 2002 (JP) ..... 2002-093109
Mar. 28, 2002 (JP) ..... 2002-093112
Mar. 28, 2002 (JP) ..... 2002-093115

(51) Int. Cl.[7] ..... E02F 5/00
(52) U.S. Cl. ..... 37/347; 414/687
(58) Field of Search ..... 37/347, 403, 417, 37/443, 466, 410, 903; 414/687, 694, 719; 180/9.1, 89.1, 6.64, 6.7

(56) References Cited

U.S. PATENT DOCUMENTS 2,893,502 A 7/1959 Scheuerpflug
3,738,442 A 6/1973 Eiler
4,102,461 A 7/1978 Soyland
4,501,334 A 2/1985 Ptacek
4,984,695 A 1/1991 Goto
5,195,863 A * 3/1993 De Pingon ..... 414/694
5,975,833 A * 11/1999 Yamada et al. ..... 414/687
6,266,901 B1 * 7/2001 Kanda et al. ..... 37/403
6,290,009 B1 * 9/2001 Kondo et al. ..... 180/9.1
6,443,687 B1 9/2002 Kaiser

FOREIGN PATENT DOCUMENTS

JP 2001-97017 4/2001

* cited by examiner

*Primary Examiner*—Robert E Pezzuto
(74) *Attorney, Agent, or Firm*—Webb Ziesenheim Logsdon Orkin & Hanson, P.C.

(57) ABSTRACT

A wheeled work vehicle includes a lower structure (4) supported on the ground by front wheels (2) and rear wheels (3), a swivel base (6) mounted on the lower structure to be swivellable about a swivel shaft disposed between the front wheels and the rear wheels, an operator's seat (7) and an implement support unit (37) which are mounted on the swivel base and an implement (9) supported to the implement support unit. An engine (13) is mounted on the lower structure (4) and the swivel base (6) is disposed at a position lower than upper ends of the front wheels (2) and rear wheels (3). The operator's seat (7) is disposed to project rearward from the swivel base so as to be able to pass above the engine during a swiveling movement of the swivel base. The swivel base (6) is disposed adjacent the engine (13) and lower than an upper end of the engine.

16 Claims, 14 Drawing Sheets

WHEELED WORK VEHICLE

BACKGROUND OF THE INVENTION

1. Field of the Invention

The present invention relates to a wheeled work vehicle having a lower structure supported on the ground by front wheels and rear wheels, a swivel base mounted on the lower structure to be swivellable about a swivel shaft disposed between the front wheels and the rear wheels, an operator's seat and an implement support unit which are mounted on the swivel base, and an implement supported to the implement support unit.

2. Description of the Related Art

A wheeled work vehicle of the above-noted type is known from Japanese Patent Application "Kokai" No. 2001-97017. In this, a swivel base is mounted via a swivel shaft on a lower structure having front and rear wheels. On this swivel base, there are mounted an upper structure including a operator's seat and a steering unit and a ground-work machine having a liftable implement. An engine of the vehicle is also mounted on this swivel base as a part or the upper structure, and the operator's seat is disposed immediately above the swivel shaft. In operation, such wheeled work vehicle like this can travel on the road at a high speed with the front and rear wheels. The vehicle is capable also of effecting a ground work such as digging with swiveling the ground-work machine and also lifting up and down the implement supported thereto. However, since the engine is mounted on the swivel base, the upper structure has a significant rearward extension forming a very long distance between the swivel shaft and the rear end of the structure. Moreover, the rear end of the upper structure protrudes significantly from the rear end of the rear wheels. These result in not only running instability of the vehicle, but also great difficulty in a swiveling work in a limited space. Further, as the engine is mounted on the swivel base, the center of gravity of the vehicle is at a relatively high altitude, which adds to the traveling instability. And, because of the significant mass of the upper structure, the swiveling workability of the vehicle cannot be improved easily. In addition, the ground-work machine can effect only upward/downward pivotal movement. Hence, swiveling of the swivel base allows only a work forwardly of the operator's seat, not allowing such sideways work as side ditch digging for excavating a wall edge to be effected by e.g. a backhoe. In this way, the application of this work vehicle is very limited and a digging or excavating work in a limited space is very difficult.

A wheeled work vehicle having an engine mounted on its lower structure is known from U.S. Pat. No. 2,893,502. In this, the swivel base including front and rear wheels supported thereto is disposed at a higher position than the lower structure. Hence, in the construction too, the center of gravity is high, resulting instability in the traveling of the vehicle as well as in a work effected by the implement.

SUMMARY OF THE INVENTION

A primary object of the present invention is to provide an improved wheeled work vehicle capable of stable work with lowered center of gravity, thus solving the above-described drawbacks of the conventional art.

For accomplishing the above-noted object, according to a wheeled work vehicle of the invention, the engine is mounted on the lower structure and the swivel base is disposed at a position lower than upper ends of the front wheels and rear wheels.

With this construction, the engine is mounted on the lower structure, thereby to reduce the mass of the upper structure and also the swivel base is disposed at a low position, so that the center of gravity of the vehicle is lowered for allowing stable traveling and working of the vehicle.

Further, in order to allow the engine to be mounted on the lower structure and also to improve the swivelability of the swivel base (e.g. for its 360 degree swiveling), the invention proposes another wheeled work vehicle. In this, the engine is mounted on the lower structure and the swivel base is disposed adjacent the engine. Further the operator's seat mounted on the swivel base extends outwardly and upwardly from the periphery of the swivel base so as to be able to pass above the engine during a swiveling movement of the swivel base. According to a still further wheeled work vehicle proposed by the present invention, the engine is mounted on the lower structure and the swivel base is disposed adjacent the engine and lower than an upper end of the engine.

With the wheeled work vehicles of the invention having the above-described features, the swivel base including the operator's seat and the implement is disposed at a position lower than the highest position of the lower structure so as to allow 360 degrees swiveling movement of the swivel base. And, by increasing the weight of the lower structure thus correspondingly reducing the weight of the upper structure, the traveling stability, the working stability, the swiveling workability are improved and also both vertical and fore-and-aft dimensions of the vehicle are reduced while ensuring easiness for the operator in getting on and off the vehicle as well as large space for the operator mounting on the vehicle and simplicity of the entire vehicle construction.

According to one preferred embodiment of the invention, the lower structure mounts, between the front and rear wheels, a fuel tank and a working fluid tank which are distributed on opposed sides in the traverse direction of the structure. This arrangement improves the lateral, the right/left balance of the lower structure.

According to another preferred embodiment of the invention, a power transmission mechanism for transmitting power of the engine to drive wheels is disposed forwardly of the engine and downwardly of the swivel base. Preferably, this power transmission mechanism includes a hydrostatic transmission (HST) having an input shaft and an output shaft which are disposed on the left and right of the transmission and extend substantially along the fore-and-aft direction. This arrangement allows the power transmission line of the lower structure to be disposed in this lower structure in a space-efficient manner.

According to a still further preferred embodiment of the invention, a rear portion of the swivel base is adjacent the engine and a forward portion of the swivel base is overlapped with the front wheels. This arrangement achieves maximum utilization of the space in the lower structure available for mounting the swivel base thereon and also greater fore-and-aft compactness of the lower structure.

According to a still further preferred embodiment of the invention, the implement support unit includes a support member and a swing shaft which are provided on the swivel base, and a swing member which can pivot about the swing shaft by a swing cylinder; and the swing member projects outward from a swiveling path of the swivel base. These arrangements allow stable support and lateral pivotal movement of the implement above the swivel base and prevent the swing member from adversely affecting the swivelability of the swivel base.

Further and other features and advantages of the invention will become apparent upon reading the following detailed description of the embodiments thereof with reference to the accompanying drawings.

DESCRIPTION OF THE PREFERRED EMBODIMENTS

Figure 1:
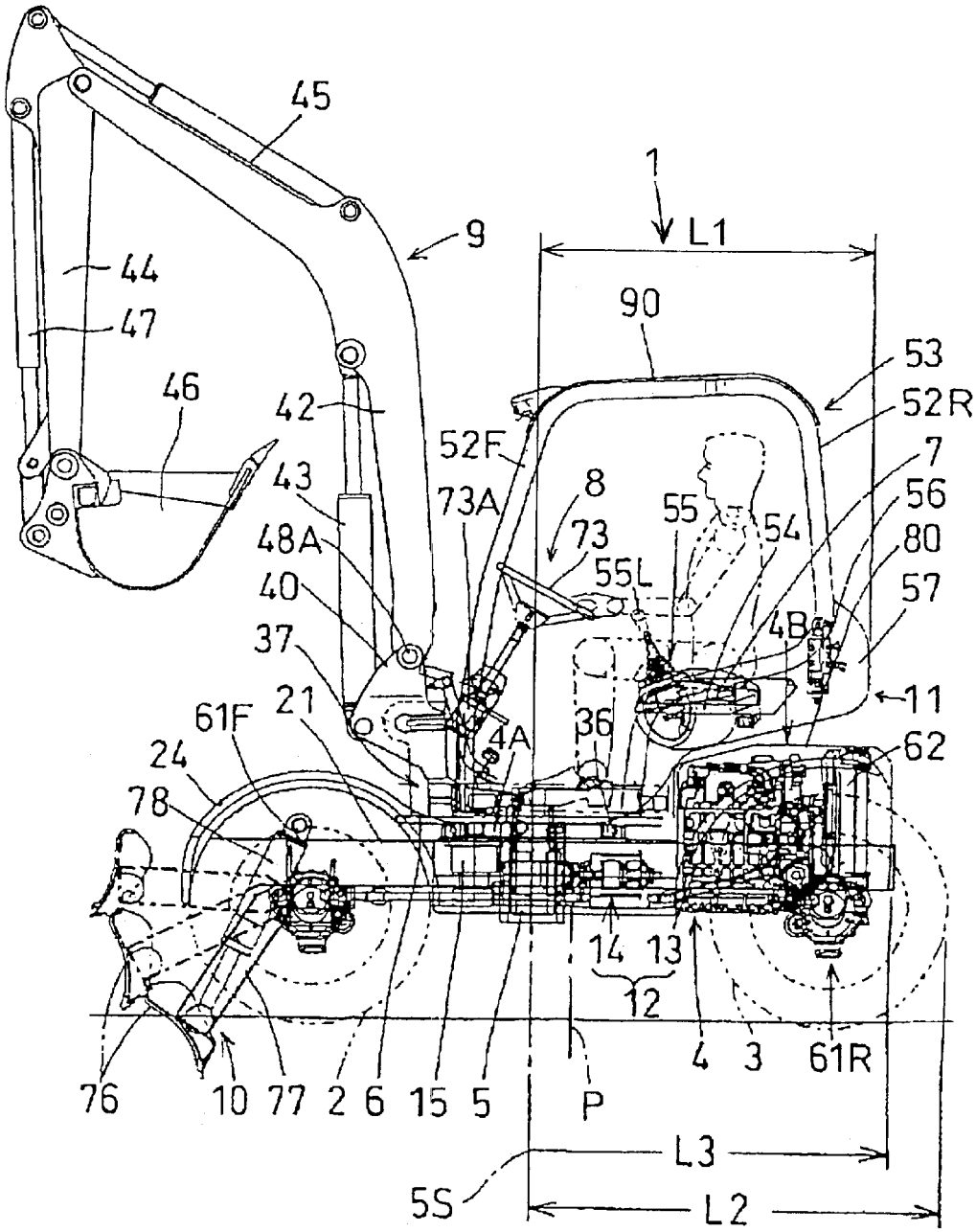
FIG. 1 is an overall side view showing a wheeled work vehicle relating to an embodiment of the invention, showing respective components of the vehicle in transparency with their contours alone.
Figure 2:
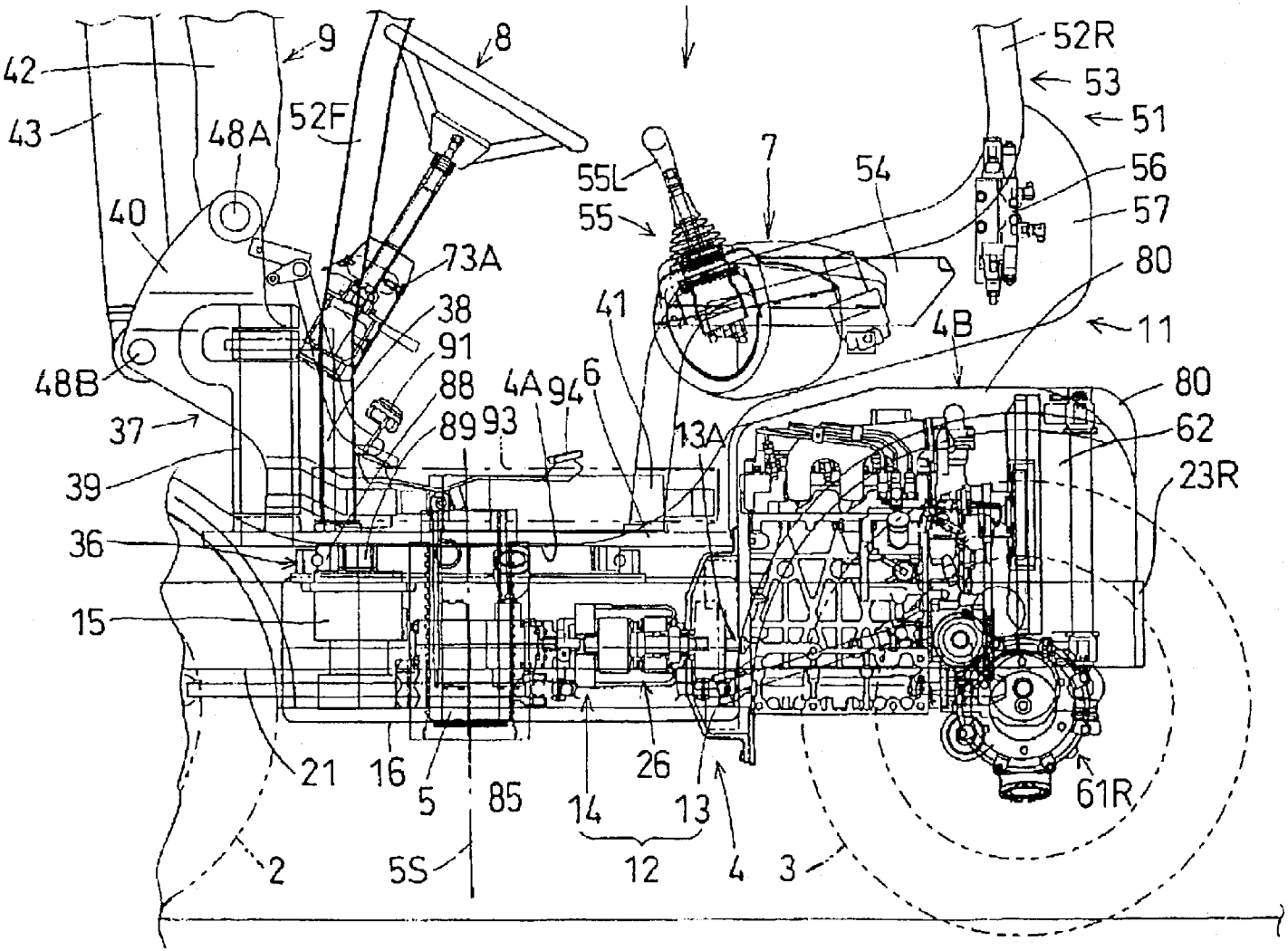
FIG. 2 is a side view showing an area including a swivel base and a driver's seat, again showing components in transparency with their contours only.
Figure 3:
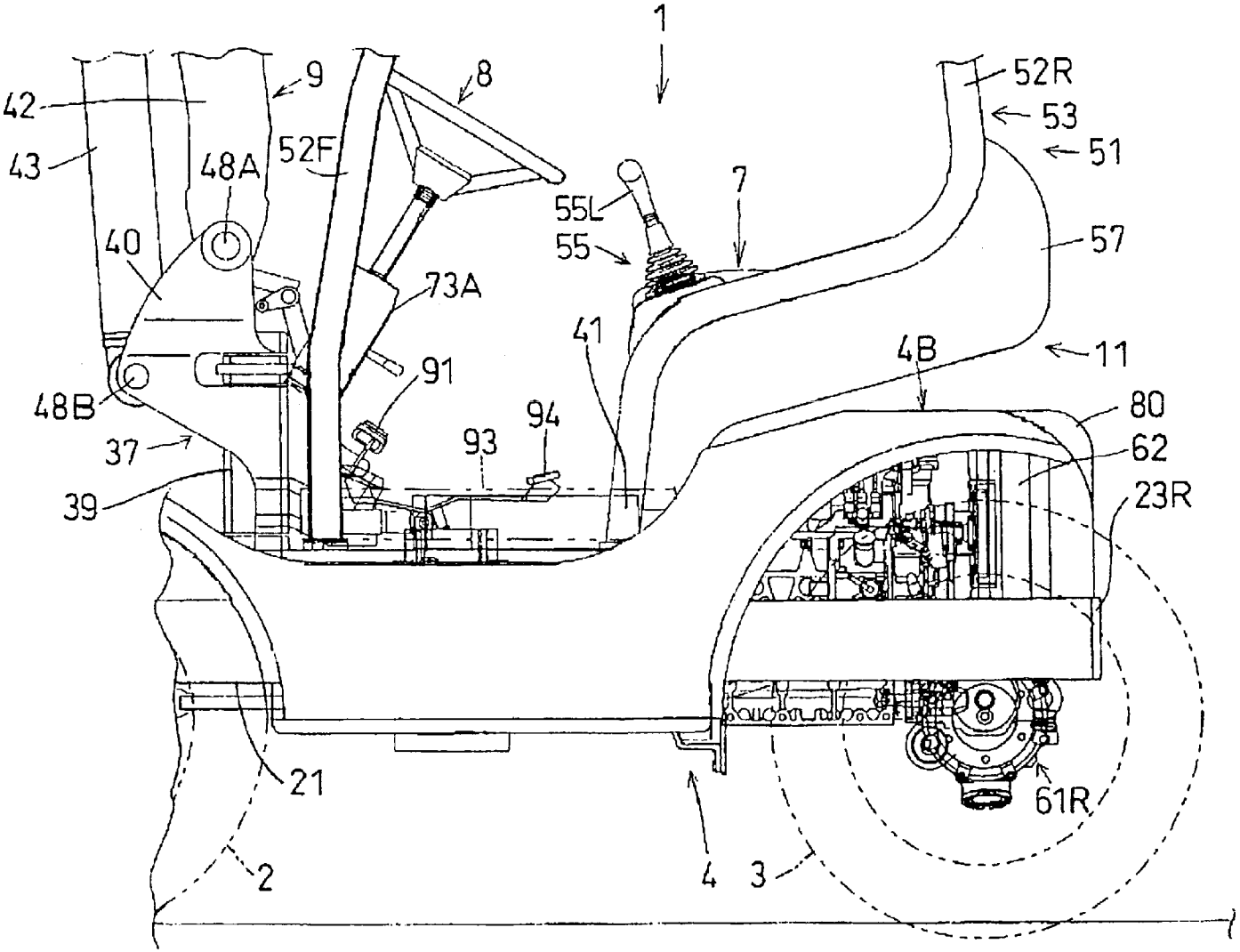
FIG. 3 is a side view showing the area including the swivel base and the driver's seat.
Figure 4:
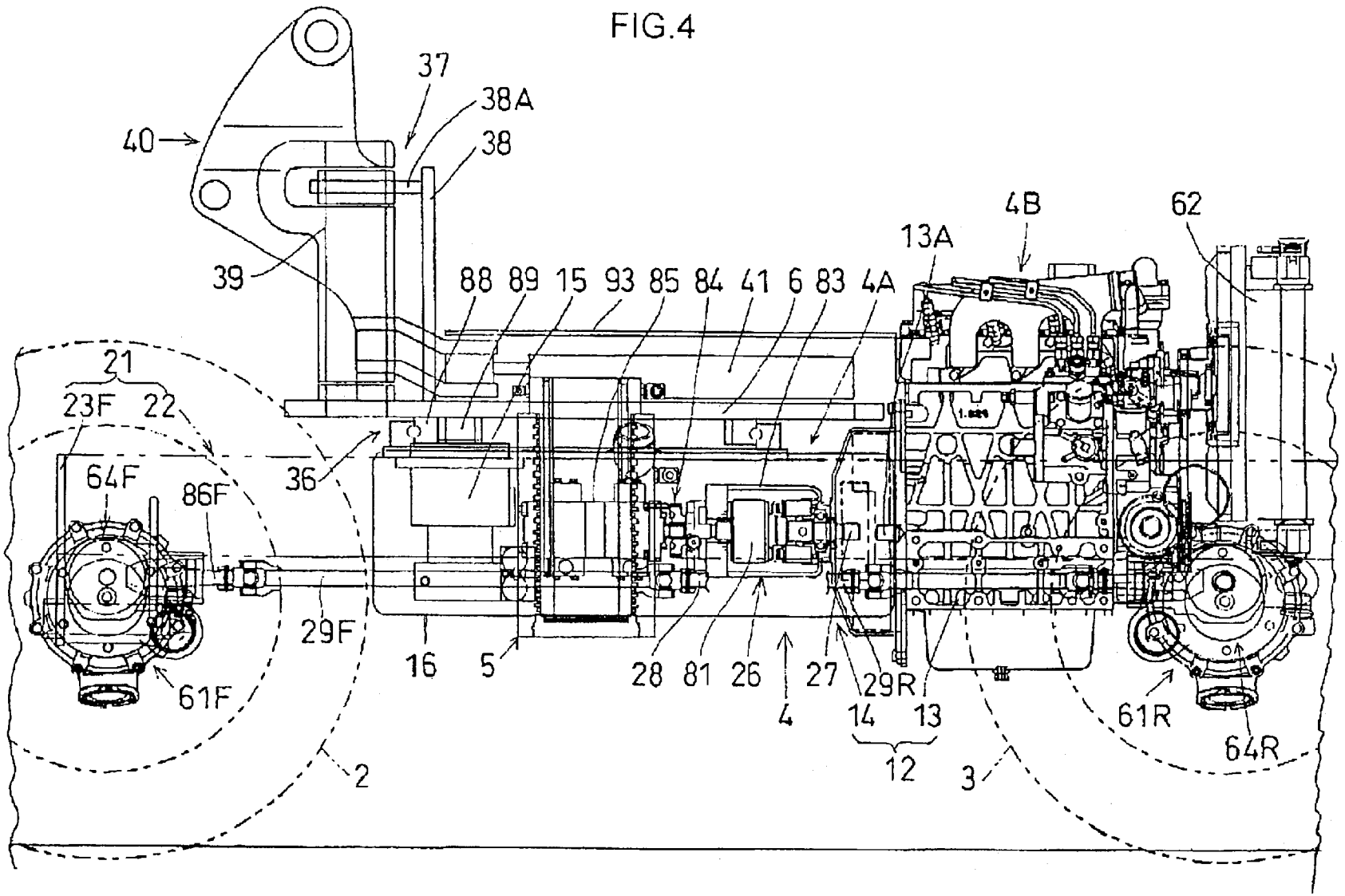
FIG. 4 is a side view showing an area including a lower structure, showing respective components in transparency with their contours alone.
Figure 5:
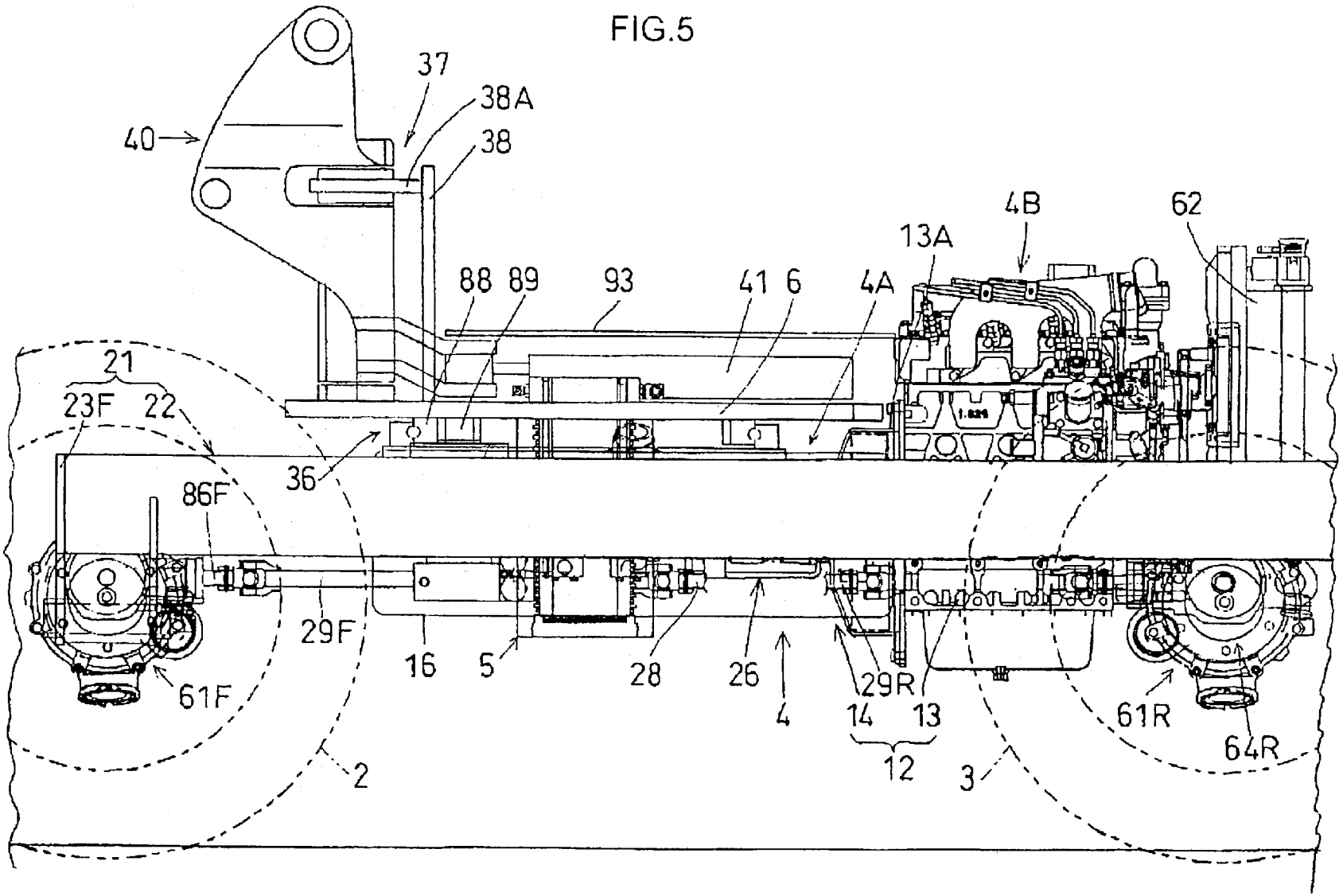
FIG. 5 is a side view showing the area of the lower structure.
Figure 6:
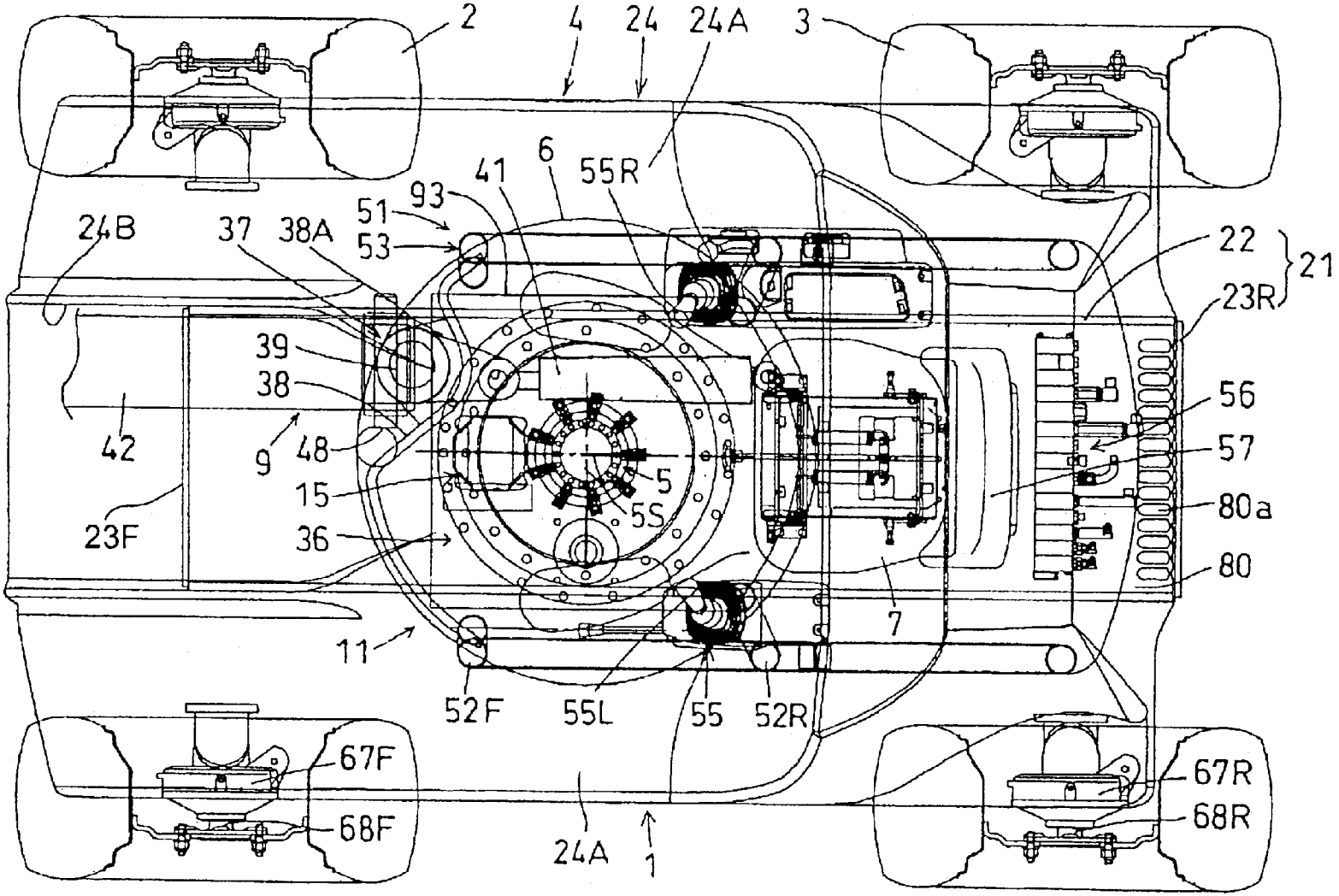
FIG. 6 is an overall plan view of a wheeled work vehicle, showing the respective components thereof in transparency with their contours alone.
Figure 7:
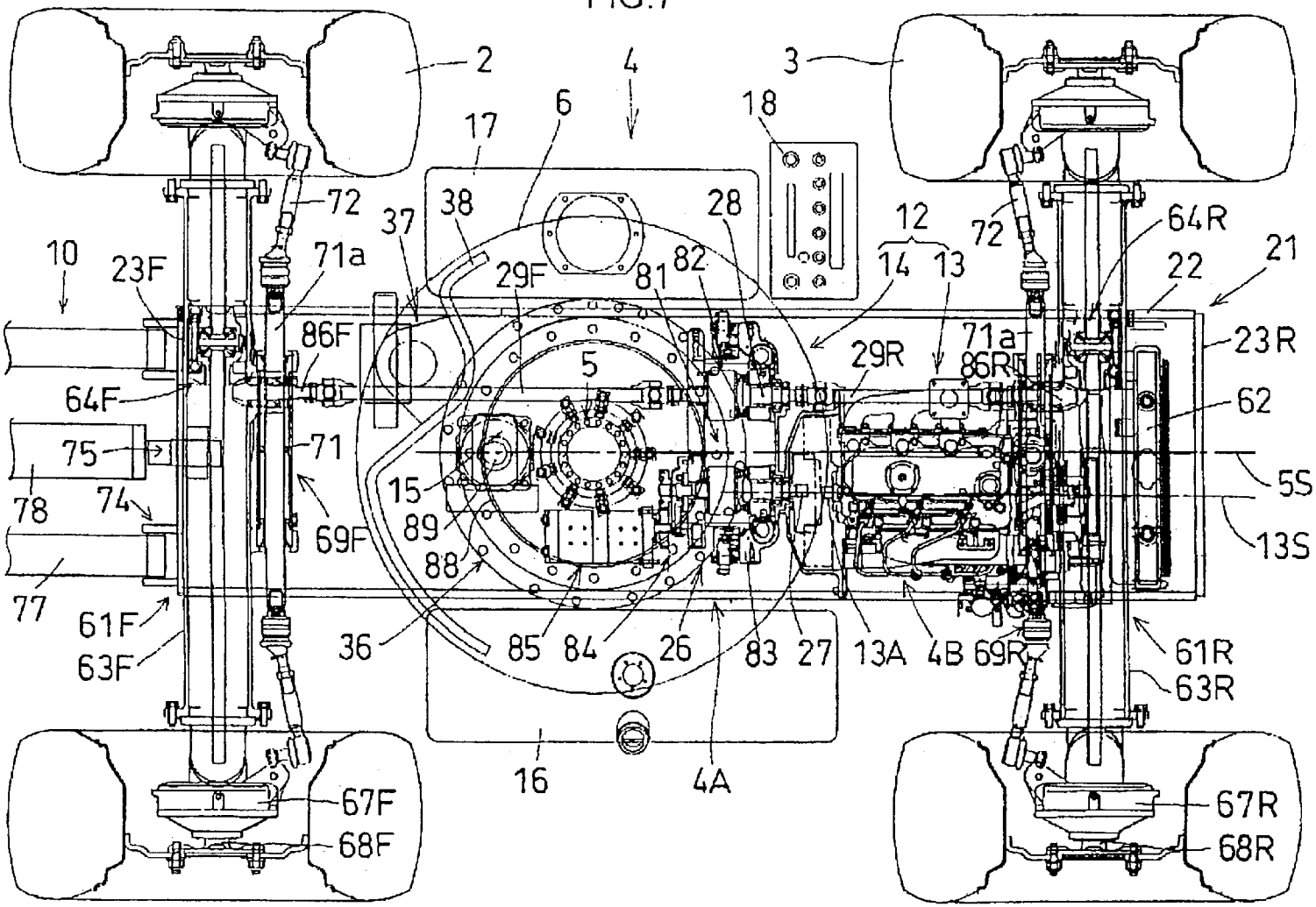
FIG. 7 is a plan view of a lower structure showing the respective components thereof in transparency with their contours alone.
Figure 8:
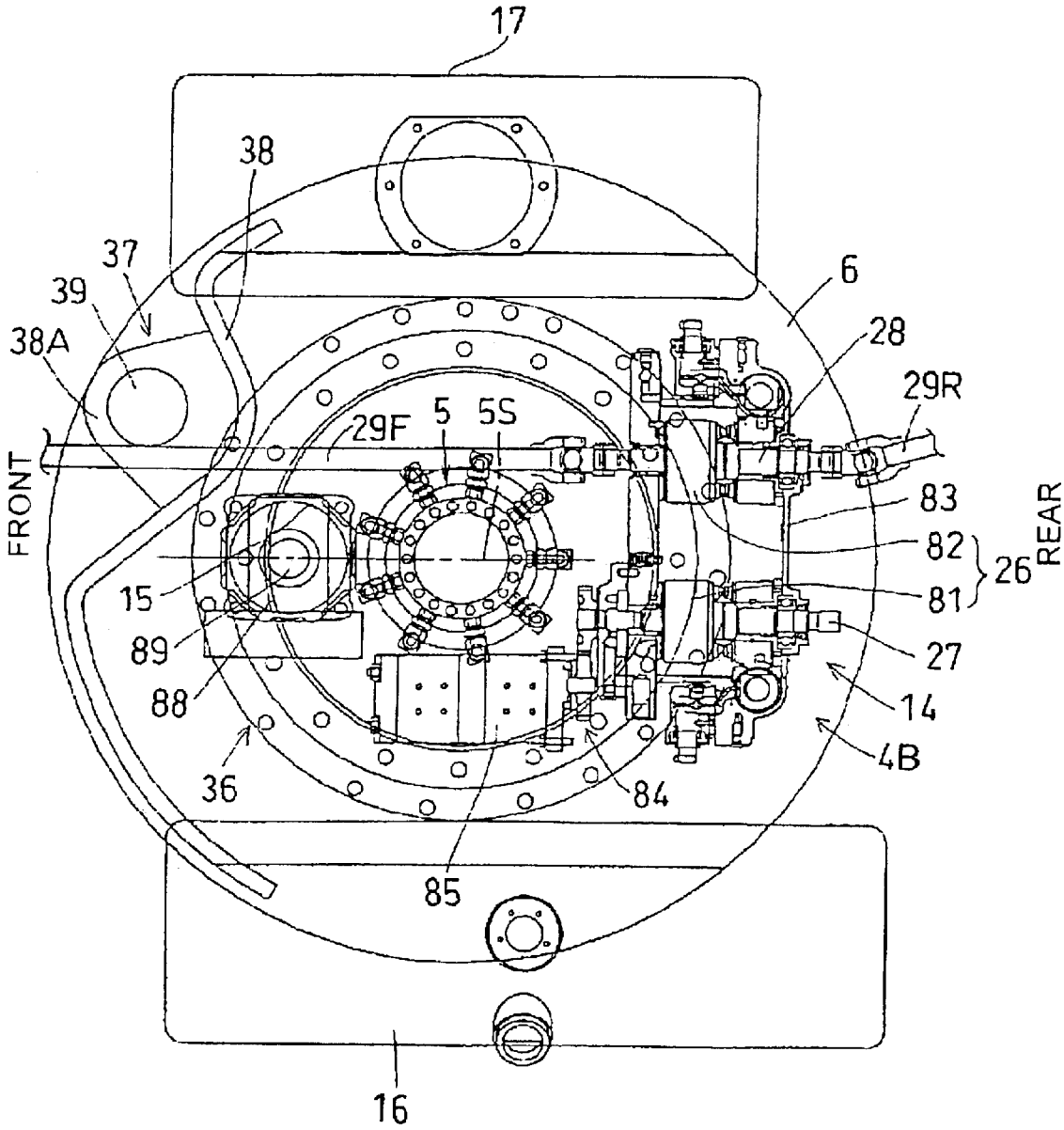
FIG. 8 is a plan view of a traveling drive unit showing the respective components thereof in transparency with their contours alone.
Figure 9:
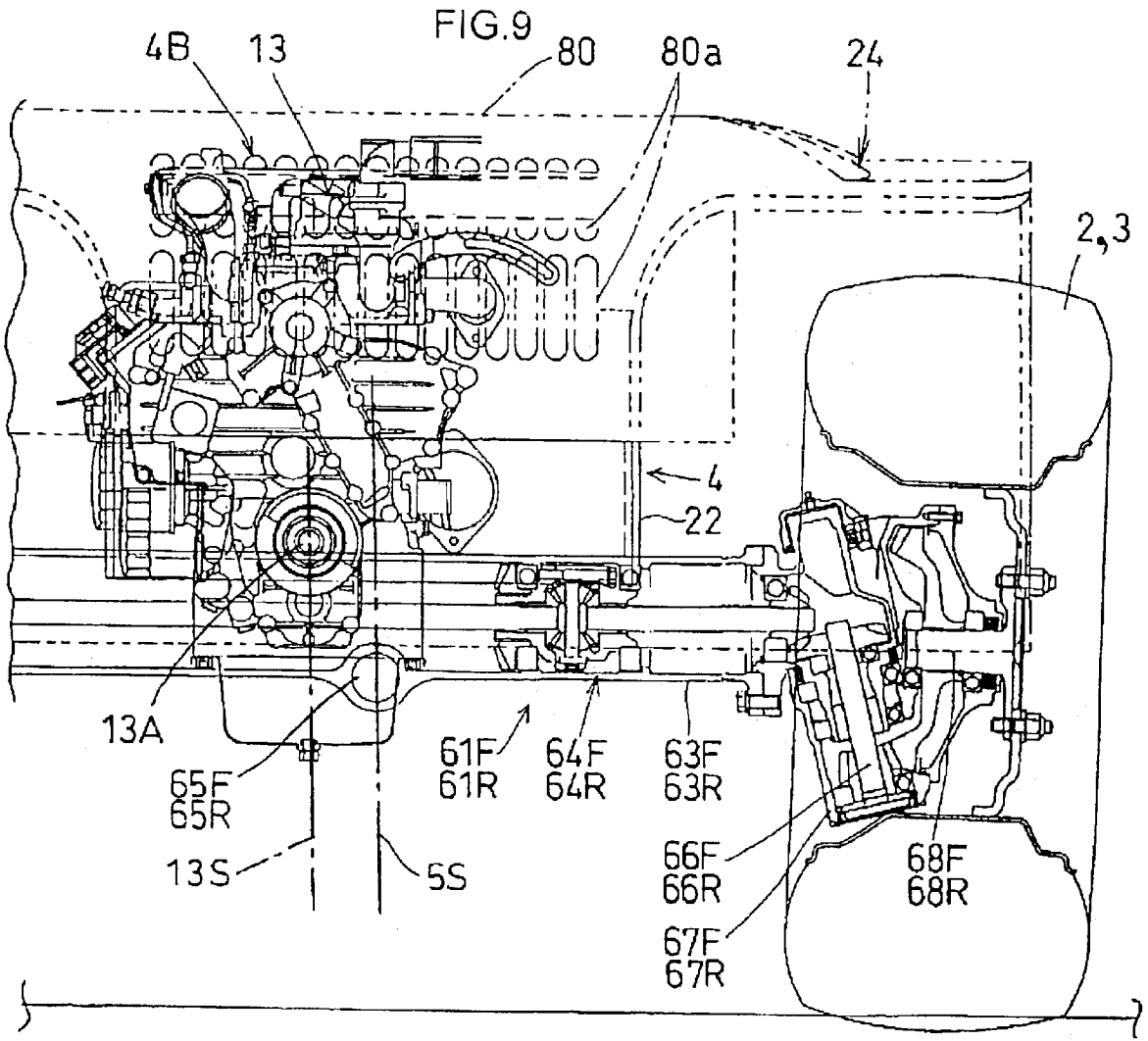
FIG. 9 is a rear view in section of a wheel unit showing the respective components thereof in transparency with their contours alone.
Figure 10:
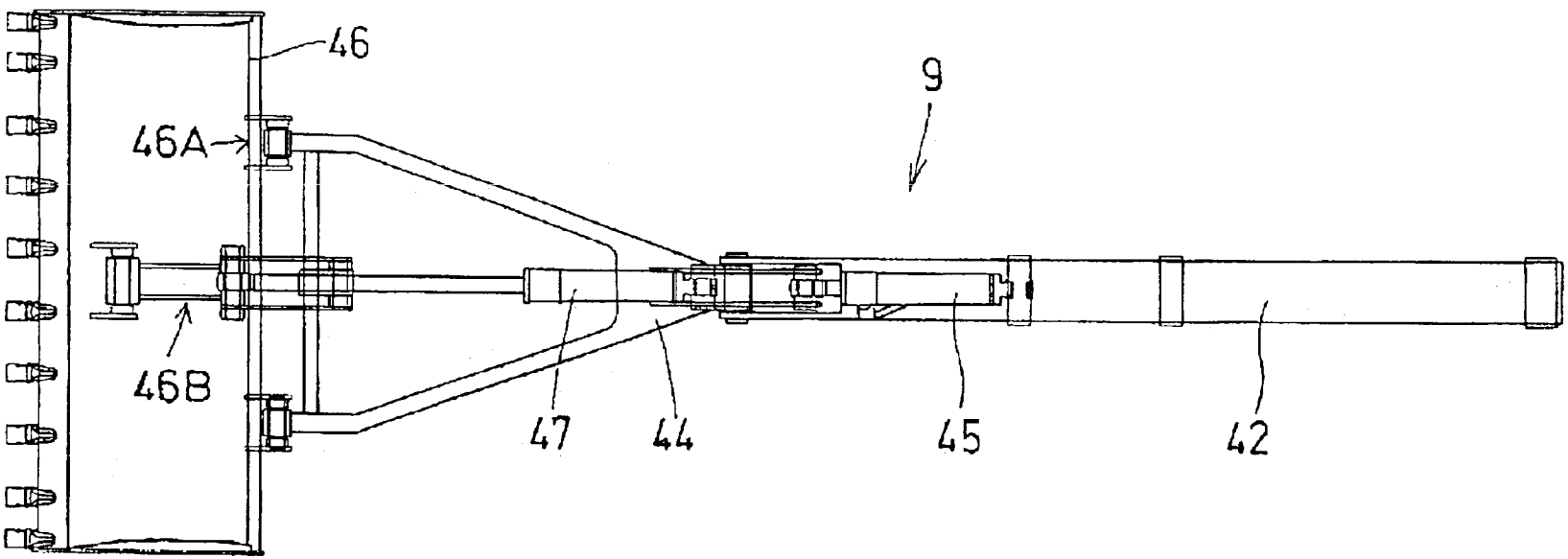
FIG. 10 is a plan view of a leading end of ground-work machine.
Figure 11:
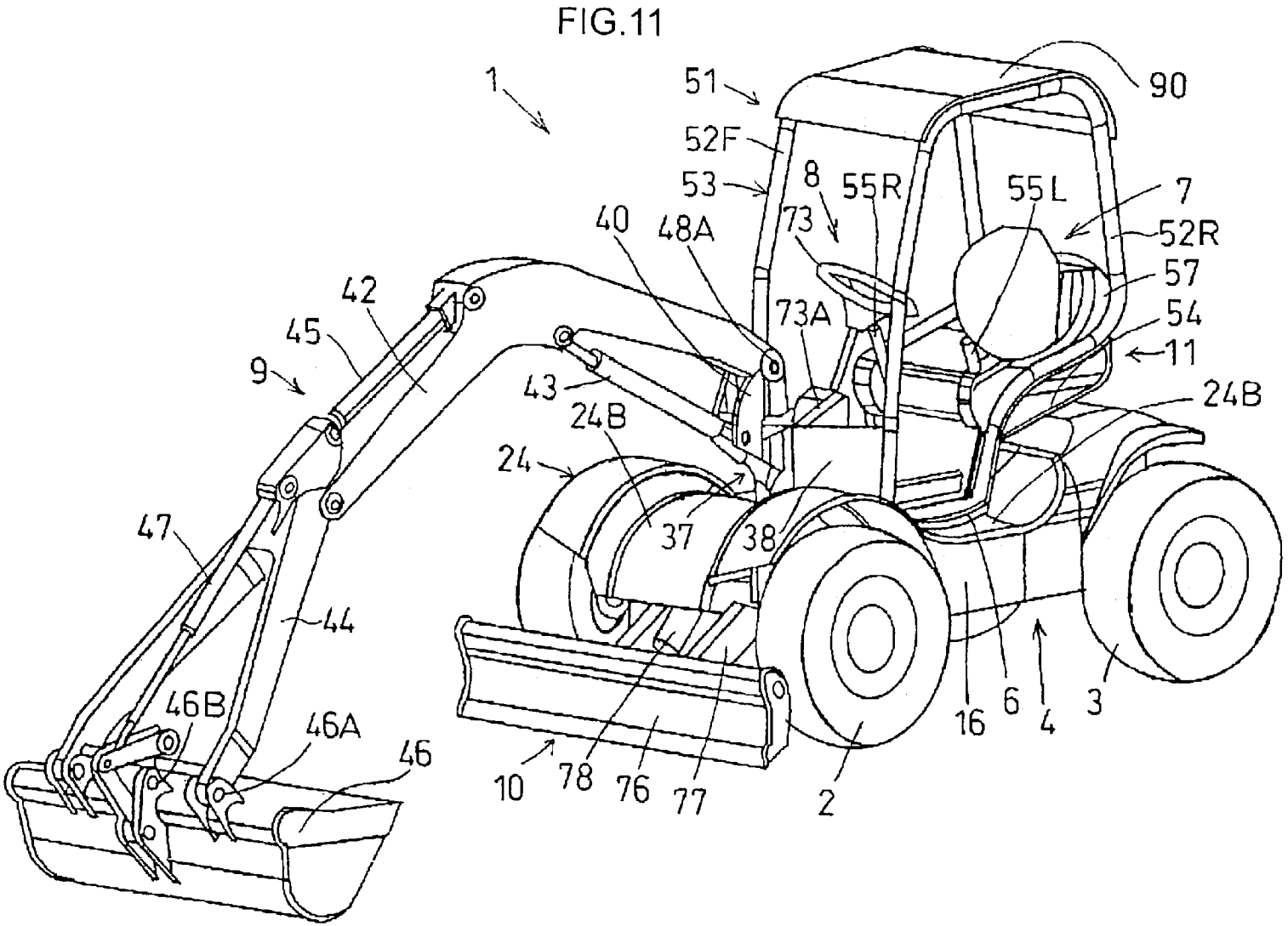
FIG. 11 is a perspective show showing the wheeled work vehicle in its entirety as seen from the front side.
Figure 12:
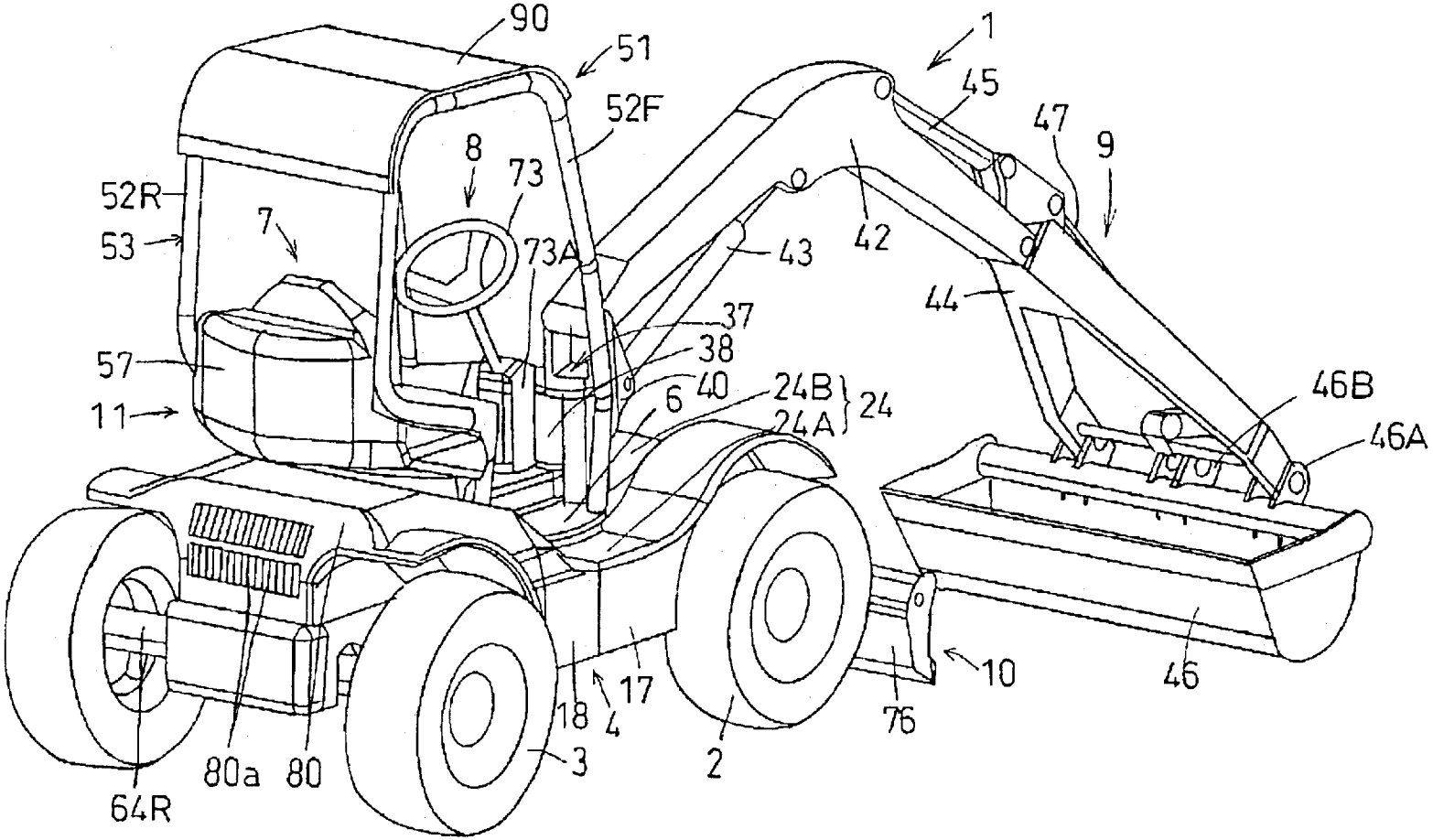
FIG. 12 is a perspective show showing the wheeled work vehicle in its entirety as seen from the rear side.

FIGS. 1 through 12 show a wheeled work vehicle 1 relating to one embodiment of the present invention. In order to allow visual confirmation of many components constituting this wheeled work vehicle 1, except for FIGS. 3 and 5, the figures basically show the components in transparency with their contours alone.

This wheeled work vehicle 1 includes a lower structure 4 to be supported on the ground with a pair of right and left front wheels 2 and a pair of right and left rear wheels 3, a swivel base 6 mounted via a swivel shaft 5 to the lower structure 4, an upper structure 11 including an operator's seat 7 and a steering unit 8, a ground-work implement 8 mounted on the swivel base 6, and a stabilizer 10 disposed at a front portion of the lower structure 4.

The lower structure 4 includes a traveling drive unit 12 having an engine 13 and a power transmission mechanism 14, a vehicle frame 21, front wheel units 61F suspending the front wheels 2 therefrom, rear wheel units 61R suspending the rear wheels 3 therefrom, and so on. Incidentally, in the lower structure 4, the portion or side thereof mounting the engine 13 will be referred to as a rear portion and the opposite portion or side thereof mounting the stabilizer 10 will be referred to as a front portion, respectively. A steering unit 8 is disposed forwardly of the operator's seat 7.

As may be seen from FIGS. 4, 5, 6 and 7, the vehicle frame 21 is provided as a rectangular framework formed by interconnecting front and rear portions of a pair of right and left rectangular plate-like side frames 22 with plate-like front and rear frames 23F, 23R. And, inside the rear portion of this vehicle frame 21, the engine 13 is disposed and connected to the right and left side frames 22 and a radiator 62 is mounted on the rear portions of the right and left side frames 22.

Each front wheel unit 61F includes a cylindrical front axle case 63F and a front wheel differential unit 64F accommodated therein. The right-to-left center of this front axle case 63F is supported to the front lower portion of the vehicle frame 21 via a center pin 65F extending in the fore-and-aft direction, thereby to allow the right and left ends of the unit to be vertically pivotable. Further, at a right or left end of the front axle case 63F, there is provided an end transmission case 67F to be pivotable about a king pin 66F and the front wheel 2 is mounted on an axle 68F supported to this end transmission case 67F. With this, the right and left front wheels 2 are steerable via the respective end transmission cases 67F by a front steering means 69F.

Like the front wheel unit 61F described above, each rear wheel unit 61R includes a cylindrical rear axle case 63R and a rear wheel differential unit 64R accommodated therein. The right-to-left center of this rear axle case 64R is supported the rear lower portion of the vehicle frame 21 via a center pin 65R extending in the fore-and-aft direction, thereby to allow the right and left ends of the unit to be vertically pivotable. Further, at right or left end of the rear axle case 63R, there is provided an end transmission case 67R to be pivotable about a king pin 66R and the rear wheel 3 is mounted on an axle 68R supported to this end transmission case 67R. With this, the right and left rear wheels 3 are steerable via the respective end transmission cases 67R by a rear steering means 69R.

Each steering means 69 includes a hydraulic cylinder 71 provided in the axle case 63 and a tie rod 72 interconnecting opposed ends of a piston rod 71*a* of the hydraulic cylinder 71 and the right and left end transmission cases 67, so that with a movement of the piston rod 71*a* to the right or left the steering means 69 pivots the right and left transmission cases 67 about the king pin 66, thereby to steer the wheels 2, 3.

The lower structure is a two-shaft, four-wheel drive construction in which the power is transmitted from the traveling drive unit 12 to both the front wheel differential unit 64F and the rear wheel differential unit 64R and also a four-wheel steering type construction in which the front and rear wheels are steerable in opposite directions (or may be in a same direction) via the front and rear steering means 69F, 69R in response to a steering operation by a single steering wheel 73.

However, the lower structure 4 may alternatively constructed such that either the front wheels 2 or the rear wheels 3 alone are provided as the drive and steerable wheels with the other as driven and non-steerable, i.e. straight traveling, wheels. Further alternatively, the structure may be constructed such that either the front wheels 2 or the rear wheels 3 alone are constantly driven and steered and the other are driven and steered only when needed.

Further, in the illustrated embodiment, the front and rear wheels 2 and 3 have substantially same diameter. Instead, one of them may have a greater or different diameter than the other.

As may be seen from FIGS. 1, 2, 3, 7 and 8, downwardly of the swivel base 6 and on right and left sides (side frames 22) of the lower structure 4 and between the front and rear wheels 2, 3, there is disposed a fuel tank 16 on one side (left side) and there are disposed a working fluid tank 17 and a battery 18 behind it on the other side (right side). The right and left arrangement of these tanks, i.e. the fuel tank 16 and the working fluid tank 17 may be reversed. In either case, with this right and left distribution of the tanks, the right and left weight balance of the lower structure 4 is improved and also the space between the front and rear wheels 2, 3 is efficiently utilized.

At the front portion (front frame 23) of the lower structure 4, in order to amount the stabilizer 10 at this portion, a pair of right and left arm supports 74 and a central upper cylinder support 75 project forwardly.

The stabilizer 10 includes a blade 76, a pair of right and left arms 77 attached to the blade 76 and pivotally supported to the arm supports 74 to be liftable about horizontal axes, and an operational cylinder 78 supported to the cylinder support 75 for lifting the stabilizer 10 up and down so as to bring the blade 76 into contact with the ground surface or insert it into the ground.

This stabilizer 10 is mounted to the lower structure 4 on the opposite side from the engine 13. Instead, the stabilizer 10 may be disposed on the same side as the engine 13 or may be disposed at the rear side of the lower structure 4 as well. The stabilizer 10 has a substantially same construction and substantially same function as a dozer device of a backhoe. However, if the ground-work implement 9 is used mainly for ground excavating work, then, the main function of the stabilizer is to stabilize the lower structure 4 (i.e. function as an outrigger).

The lower structure 4 further includes a cover 24 attached to the vehicle frame 21 for covering the upper surface of the structure as well as the front and rear wheels, 2, 3, the fuel tank 16, the working fluid tank 17, the battery 18, etc. Although this cover 24 can be formed of a synthetic resin, it is preferred that the cover 24 be formed of an iron plate having a relatively large thickness so as to act as a "weight" for improving the stability of the lower structure 4 during a ground work.

More particularly, as shown in FIGS. 2, 3, 6, 11 and 12, the cover 24 has a substantially rectangular shape in plan view and a front portion thereof is formed concave having a recess 24B between fenders of the right and left front wheels 2, formed lower than the uppermost portions of the front wheels 2, so as not to interfere with the ground-work implement 9 during a front digging operation. Further, the portion of the cover 24 between the front and rear wheels 2, 3 too is formed concave, so that right and left side portions of the cover respectively covering the fuel tank 16 and the working fluid tank 17 are provided as step portions 24A for facilitating an operator's access on and off the swivel base 6.

Namely, the cover 24 functions as the fenders, the weight and also as the step portions. So that, the operator may ride not only the steps 24A but also any other portions of the cover.

The lower structure 4 having the cover 24 has a portion thereof downwardly of the swivel base 6 provided as a flat portion 4A and a further portion thereof rearwardly of the swivel base 6 as a raised portion 4B. To this raised portion 4B, an engine hood 80 forming a portion of the cover 24 is detachably attached to be opened and closed. Mark 80*a* denotes air vents formed in the engine hood 80.

Within the engine hood 80 attached to the raised portion 4B of the lower structure 4, the engine 13 is mounted and in the flat portion 4A thereof, the power transmission mechanism 14 is mounted. And, the swivel base 6 is disposed upwardly of the flat portion 4A housing the power transmission mechanism 14. The engine 13 projects downwardly of the swivel base 6.

The engine 13 may be disposed with the axis of its crank shaft 13A being oriented along the right and left direction. In this case, however, the engine is disposed along the fore and aft direction, with the right-and-left center 13S thereof being offset to one side (left side) from the right-and-left center of the vehicle frame 21 (extending through a center 5S of the swivel shaft 5).

The radiator 62 disposed rearwardly of the engine 13 may alternatively be disposed at the right-and-left center of the vehicle frame 21. In this case, however, the radiator 62 is disposed with offset to the same side as the engine 13. With these arrangements, the center of gravity of the lower structure 4 is slightly offset to the left side, in the opposite direction to the disposing position of the ground-work implement 9 to be described later.

The power transmission mechanism 14 disposed at the flat portion 4A can be a mechanical transmission mechanism. In this case, however, this mechanism 14 is provided as a hydrostatic transmission 26 including a pump 81 and a motor 82. A transmission case 83 for this transmission 26 supports an input shaft 27 for the pump 81 for receiving the power from the engine 13 and an output shaft 28 of the motor 82. And, these shafts are respectively aligned substantially with the fore and aft direction and are distributed on the right and left sides offset from the right and left center of the vehicle frame 21.

The input shaft 27 projects forwardly and rearwardly from the transmission case 83, with its rear portion being coupled via a flywheel to the crank shaft 13A and its front portion being operable to drive via a pair of gears 84 a hydraulic pump 85 for feeding the working fluid.

The output shaft 28 also projects forwardly and rearwardly from the transmission case 83 to be connected respectively via front and rear universal joint shafts 29F, 29R to bevel pinion shafts 86F, 86R of the front differential unit 64F and the rear differential unit 64R. In this way, by using the front and rear universal joint shafts 29F, 29R for power transmission to the front and rear wheels 2, 3, the vertical pivotal movements of the front and rear axle cases 63F, 63R are allowed even at positions offset in the right and left direction from the center pins 65F, 65R.

In FIGS. 2 through 6, the lower structure 4 mounts thereon the swivel shaft 5 and a swivel bearing 36 for swivelably supporting the swivel base 6, a ring gear 88 attached along the inner periphery of the swivel bearing 36, a drive pinion 89 meshing with this ring gear 88, and a hydraulic swivel motor 15 for driving the drive pinion 89 for swiveling the swivel base 6.

The swivel shaft 5 mounted at the center 5S of the swivel bearing 36 is constructed as a swivel joint, so that connections of working fluid passages connecting the hydraulic pump 85 to the ground-work implement 9, electric cables interconnecting the steering unit 8 and the traveling drive unit 12 and so on can be carried out even during the swiveling movement of the swivel base 6.

The above-described components including the swivel motor 15, the universal joint shafts 29, and the hydraulic pump 85 constitute some parts of the power transmission mechanism 14 of the traveling drive unit 12. And, these components are disposed within the vertical width of the vehicle frame 21 and around the swivel shaft 5 in a compact manner not only in the vertical direction, but also in the fore-and-aft and right-and-left directions.

The components including the swivel base 6, the operator's seat 7 disposed at the rear upper portion of the swivel base 6 of the swivel shaft 5, the steering unit 8 disposed at the front portion of the swivel base 5 forwardly of the operator's seat 7 and so on together constitute the upper structure 11.

The center 5S of the swivel shaft 5 is slightly offset to the forward side from the center P of the axes of the front and rear wheels 2, 3. And, relative to this swivel shaft 5, the operator's seat 7 is disposed on the rear side of the swivel base 6 and the steering unit 8 and the ground-work implement 9 are disposed on the forward side thereof, respectively. The front end of the upper structure 11 is constructed as the steering unit 8 and the rear portion thereof is constructed as the operator's seat 7 with no large component being present rearwardly thereof, so that the fore-and-aft size of the structure is formed extremely short.

In the upper structure 11, the swivel bearing 36 and the swivel base 6 are disposed lower than the upper end of the engine 13 disposed at the rear portion of the lower structure 4, and of the swivel bearing 36 and the swivel base 6, at least the swivel baring 36 is disposed at a position between the front and rear wheels 2, 3 and lower than the upper ends of at least either one of the front and rear wheels 2, 3.

The swivel base 6 has a substantially circular configuration in plan view and has its rear portion disposed adjacent the engine 13 and its front portion overlapped in the fore-and-aft direction with the right and left front wheels 2. And, this swivel base 6 projects sideways to the right and left from the vehicle frame 21 to be overlapped in the right and left direction with the fuel tank 16 and the working fluid tank 17, respectively.

That is, the swivel base 6 is formed such that it has a progressively larger area defined by three points of the engine 13 disposed substantially right-and-left center and the pair of front wheels 2 disposed apart therefrom on the right and left sides. Or, after securing a necessary area for the swivel base 6, the fore-and-aft dimension and the right-and-left dimension of the lower structure 4 are set as compact as possible.

And, since the lower structure 4 mounts thereon such components as the engine 13, the fuel tank 13, the working fluid tank 17, etc., this lower structure 4 has a significant weight, whereby the weight of the upper structure is reduced correspondingly and its fore-and-aft and right-and-left dimensions may also be small.

With the above-described construction, relative to the weight of the lower structure 4 having the front and rear wheels 2, 3, the total weight of those components mounted therein such as the operator's seat 7, the steering unit 8 and the ground-work implement 9, or the total weight of at least the swivel base 6 and the operator's seat 7 and the steering unit 8 mounted thereon may be smaller.

Further, the arrangement of the power transmission mechanism 14 around the swivel shaft 5 and also the above-described triangular arrangement of the engine 13, the fuel tank 16 and the working fluid tank 17, etc. all help improve the weight balance around the swivel shaft 5.

That is to say, with the above-described work vehicle 1, in order to lower the center of gravity of the lower structure 4 for improvement of traveling stability and working stability of the vehicle, the engine 13 is mounted on the lower structure 4. Further, although the engine 13 is mounted on the lower structure 4, in order to dispose the swivel base 6 as low as possible, the engine 13 is disposed at the rear portion of the lower structure 4; and the power transmission mechanism 14 is disposed forwardly of the engine 13 so as to reduce the vertical size of the lower structure 4 downwardly of the swivel base 6.

A distance L1 measured from the center 5S of the swivel shaft 5 and the rear end of the upper structure 11 is set to be within a distance L2 measured from the center 5S of the swivel shaft 5 and the rear ends of the rear wheels 3 or at least within a distance L3 measured from the center 5S of the swivel shaft 5 and the rear end of the lower structure 4. With this, when the upper structure 11 is swiveled, this will not hit an object which may be present rearwardly.

The swivel base 6 mounts thereon an operator's seat mounting frame 51. This operator's seat mounting frame 51 includes a ROPS (roll over protection system) 53 having right and left and front and rear struts 52F, 52R disposed erect on the swivel base 6, a support member 54 disposed between lower portions of the right and left rear struts 52R, and a canopy 90 disposed upwardly of the ROPS 53. The operator's seat 7 is mounted to the ROPS 53 and/or the support member 54. The ROPS 53 is formed of pipe members.

The lower portion of each of the right and left rear struts 52R is bent in S-like or L-like shape, with the rear portion of the operator's seat mounting frame 51 rearwardly of the swivel shaft 5 projecting upwardly from the swivel base 6 and then rearwardly and upwardly of the engine 13.

Accordingly, the operator's seat 7 is disposed at a position higher than the engine 13, so that the swivel base 6 when being swiveled, can pass above the engine 13, that is, pass above the raised portion 4B which forms the highest portion of the lower structure 4.

With the above-described arrangements of mounting the engine 13 on the rear portion of the lower structure 4 and disposing the operator's seat 7 at the position projecting rearwardly and upwardly from the swivel base 6, on the swivel base 6, the operator's seat 7 is disposed on the rear portion thereof and also the steering unit 8 is disposed on the front portion thereof. Consequently, the weight of the upper structure 11 is reduced significantly and its fore-and-aft dimension may be the necessity minimum dimension.

And, the area of the swivel base 6 forwardly of the operator's seat 7 may be efficiently utilized as a space reserved for the operator and the swivel base 6 may be disposed within a limited area and at a low position, so that the entire work vehicle 1 may be formed compact in the fore-and-aft direction, the right-and-left direction and the vertical direction as well.

The ROPS 53 or the support member 54 supports manipulating units 55 disposed on the right and left sides of the operator's seat 7 for manipulating the ground-work implement. These right and left manipulating units 55 are for manipulating, via levers 55L, 55R thereof, a swing cylinder 41, a boom cylinder 43, an arm cylinder 45, an implement cylinder 47 etc. of the ground-work implement 9 to be described later. The unit can be changed in its posture from a manipulating posture (shown in FIGS. 1 and 2) for implement operation to a retracted posture inclined rearward for facilitating the operator's getting on and off the operator's seat 7.

Rearwardly of the operator's seat mounting frame 51, there are provided a control valve 56 and a counter weight 57. The support member 54 may be fixed to the ROPS 53 per se.

For allowing the high-speed vehicle run on the road, the steering unit 8 includes the steering wheel 73 for manipulating the steering means 69 and a steering controller 73A of the steering wheel 73 is attached to a support member 38 mounted erect on the swivel base 6. Further, the support member 38 pivotally supports a brake pedal 91. And, near a position where the operator's right foot is to be placed, there is provided a change-speed pedal 94 for operating the hydrostatic transmission 26 for change-speed and in its vicinity, there is provided means constituting the other steering unit 8.

The swivel base 6 mounts, at its front portion, the implement support unit 37 which supports the ground-work implement 9 with allowing the implement 9 to be pivoted to the right and left above the swivel base 6. While the steering unit 8 is disposed at the substantially right-and-left center of the front portion (may be offset to the left) of the swivel base 6, the implement support unit 37 is disposed with offset to the right so as to provide better visibility of the operating condition of the ground-work implement 9.

In this way, since the ground-work implement 9 mounted on the swivel base 6 is disposed with offset to the right, the engine 13 is disposed with offset to the left in order to make as much as possible right-and-left weight balance of the work vehicle 1.

The implement support unit 37 supports the swing shaft 39 by means of the swivel base 6 and the support member 38 mounted erect on this swivel base 6. The support member 38 is formed of an arcuate plate member elongate in the right and left direction so as to cover the front portion of the swivel base 6. And, a portion of this support member 38 opposing to the swing shaft 39 is formed concave into the swivel base 6, thereby to provide a space for disposing the swing member 40. Further, a stay 38A projects from the support member 38 to support the upper portion of the swing shaft 39. These constructions together constitute the implement support unit 37.

The swing shaft 39 pivotally supports the swing member 40 which, is pivoted by the swing cylinder 41. And, this swing member 40 pivotally supports, via horizontal shafts 48A, 48B, a boom 42 and the boom cylinder 43 for lifting this boom 42.

In the upper portion of the swing member 40, the portion thereof pivotally supporting the boom is disposed within the outer periphery of the swivel base 6, whereas its front upper portion pivotally supporting the boom cylinder 43 projects radially outward from the outer periphery of the swivel base 6.

The implement support unit 37 is disposed so as to be substantially confined within the outer periphery of the swivel base 6 and the unit 37 has a height so set as to allow the boom 42 and the boom cylinder 43 to pass above the highest position (the upper end of the engine hood 80) of the lower structure 4.

The swing cylinder 41 is disposed upwardly of the swivel base 6, so that when the swing member 40 is pivoted, the cylinder can pass above the swivel shaft 5. With this arrangement for allowing the swing cylinder 41 to pass above the swivel shaft 5, the swing cylinder 41 can have a long length for ensuring sufficient large pivot angle for the swing member 40.

As the swing cylinder 41 is disposed where the operator seated in the operator's seat 7 will place his/her foot, an under-foot cover 93 is provided for covering the swing cylinder 41 from above while allowing its pivotal movement.

The front upper portion of the swing member 40 pivotally supporting the boom 42 and the boom cylinder 43 projects radially outward from the swivel base 6. Further, when the member 40 assumes the position facing forward, it is located rearwardly of the front axle 68F. The base portion of the boom cylinder 43 downwardly of the boom 42 is disposed at a higher position the engine 13 (the upper end of the engine hood 80). With this, when the boom 42 is swiveled to the rear side, this boom will not contact the engine hood 80, provided the boom cylinder 43 assumes a posture more upward than the horizontal posture.

That is to say, when the ground-work implement 9 on the swivel base 6 is swiveled, this will not collide the lower structure 4. Therefore, the vehicle can carry out a ground work with the swivel base 6 assuming the backward posture. Hence, the ground work such as an excavating work is possible over the entire movable range of the lower structure 4.

The ground-work implement 9 includes, at the leading end of the boom 42, an arm 44 which is vertically pivotable by an arm cylinder 45. And, at the leading end of this arm, there is provided an implement (bucket or the like) 46 which can be pivoted up and down by the implement cylinder 47.

The leading end of the arm 44 is formed as a forked shape in the right and left direction for allowing stable attachment of an implement 46 having a greater width. The implement 46 includes, in the back face thereof, a pair of right and left arm connecting portions 46A and one center cylinder connecting portion 46B, so that the forked ends of the arm 44 are pin-connected to the right and left arm connecting portions 46A and the implement cylinder 47 is pin-connected via a link to the link connecting portion 46B, so as to allow a scoop operation and a dump operation.

Figure 13:
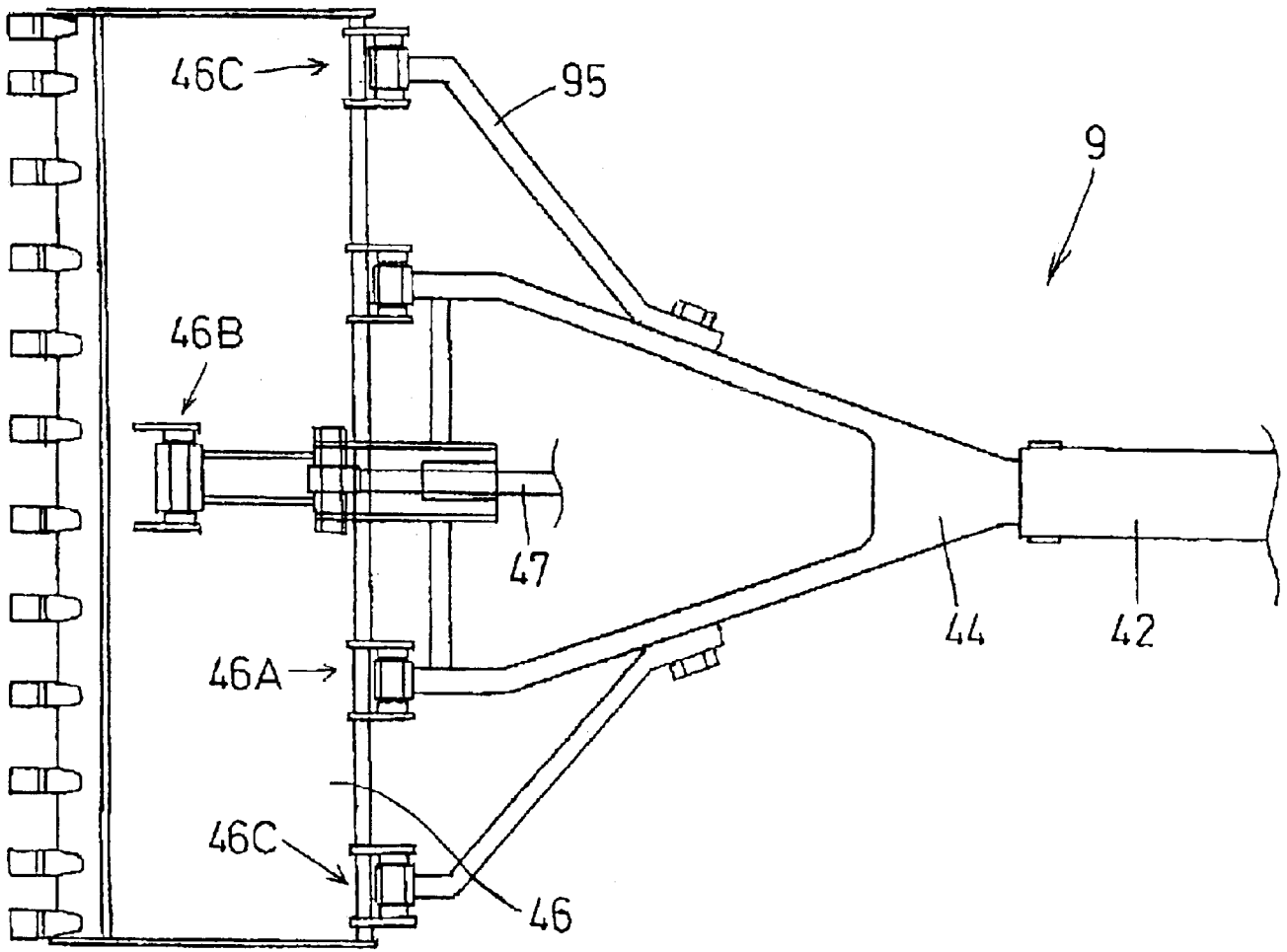
FIG. 13 is a plan view showing a first modified construction of an implement mount construction.

FIG. 13 shows a first modification of the interconnecting construction between the arm 44 and the implement 46. In this, the implement 46 includes, in its back face, a pair of auxiliary connecting portions 46C provided on the right and left outwards from the arm connecting portions 46A and reinforcing members 95 are interconnected between the right and left auxiliary connecting portions 46C and the arm 44 respectively, so as to allow stable attachment of an implement 46 of an even greater width.

Figure 14:
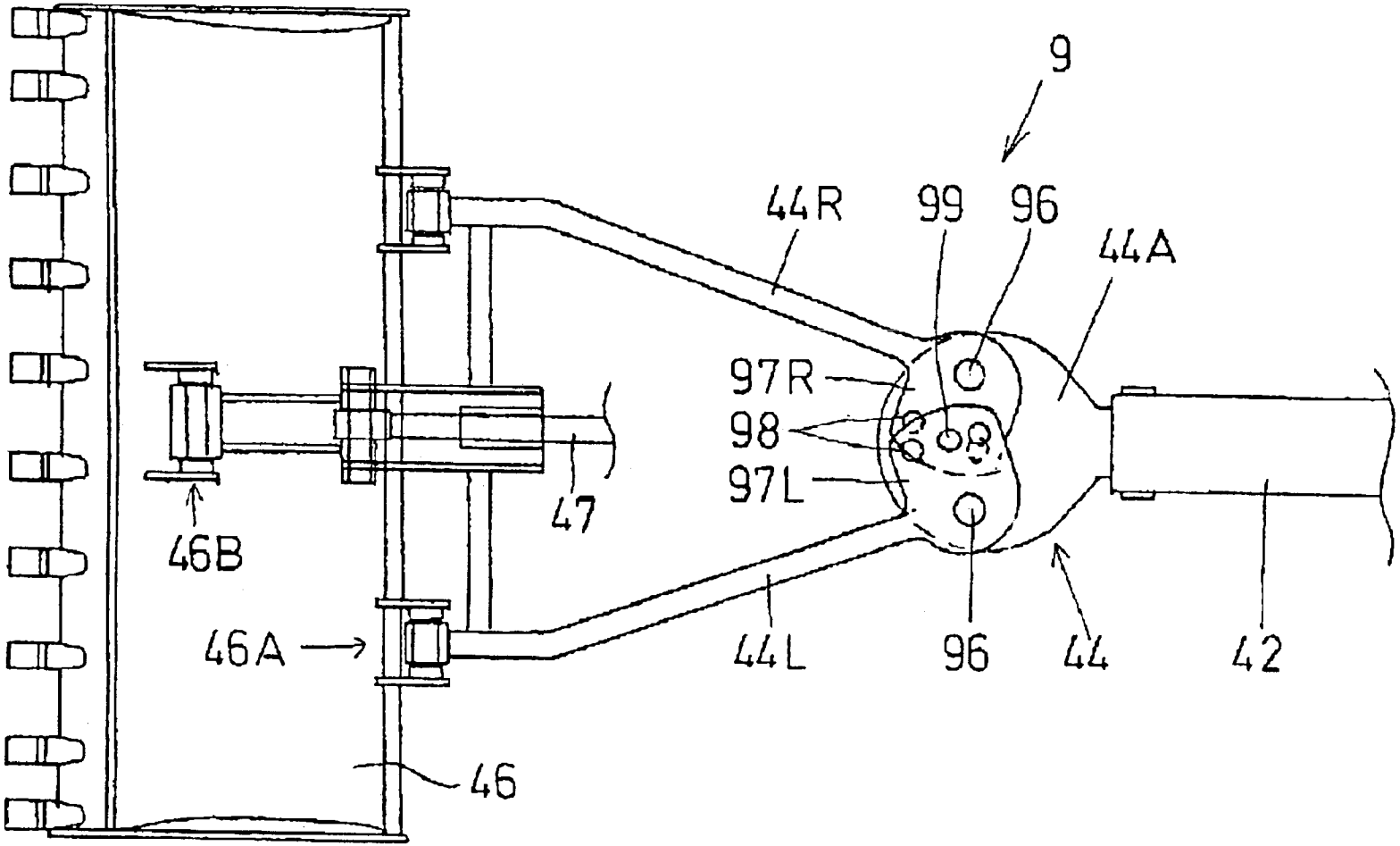
FIG. 14 is a plan view showing a second modified construction of the implement mount construction.

FIG. 14 shows a second modification of the interconnecting construction between the arm 44 and the implement 46. In this case, the left and right arm portions 44L, 44R forming the forked end of the arm 44 are pivotally supported via pins 96 to a base member 44A of the arm 44, so that the arm portions 44L, 44R can be pivoted closer to or away from each other.

The leading ends of the left and right arm portions 44L, 44R are coupled via ball joints with the arm connecting portions 46A of the implement 46 and the base portions of the arm portions 44L, 44R are pivotally supported via the pins 96 to the base member 44A of the arm 44 and integrally include extension/contraction setting portions 97L, 97R.

Extension/contraction setting portions 97L, 97R of the left and right arms 44L, 44R are overlapped with each other, with pin holes 98 which can be coaxially aligned being formed in the overlapping portions and a base member 44A of the arm 44.

Then, in attaching the arm 44, after setting the extension/contraction dimension of the left and right arm portions 44L, 44R, then, into the pin holes 98 of the extension/contraction setting portions 97L, 97R overlapped under this condition, the pins 99 are inserted and then these pins 99 are further inserted and fixed in pin holes 98 of the base member 44A of the arm 44, whereby the left and right arm portions 44L, 44R are fixed in the extended/contracted condition.

With this possibility of extending and contracting the left and right arm portions 44L, 44R relative to each other, the implements 46 having different widths can be exchanged and the implement 46 of each different width can be attached to the vehicle in a stable manner.

The above-described wheeled work vehicle 1 is constructed basically from the lower structure 4 including the front and rear wheels, 2, 3, the engine 13 and the traveling drive unit 12, the swivel base 6 disposed at the lower position than the highest position of the lower structure 4 and swivelable through the entire angular range, and the upper structure 11 including the operator's seat 7 mounted on the swivel base 6, the steering unit 8 and the ground-work implement 9. In this construction, the present invention has proposed the following characterizing features. It should noted, however, that the wheeled work vehicle 1 of the invention may be realized with only some of these characterizing features.

(a) The upper structure 11 and the ground-work implement 9 mounted on the swivel base 6 are adapted to be able to pass above the engine 13.

(b) In the lower structure 4, its portion downwardly of the swivel base 6 is formed as the flat portion 4A and its portion rearwardly of the swivel base 6 is formed as the raised portion 4B.

(c) The engine 13 is disposed at the rear portion of the lower structure 4 and the swivel base 6 is disposed at a position lower than the upper end of the engine 13.

(d) Of the swivel bearing 36 and the swivel base 6 at least the swivel bearing 36 is disposed between the front and rear wheels 2, 3 and at a position lower than the upper end of at least one of them.

(e) The implement support unit 37 is disposed substantially within the outer periphery of the swivel base 6.

(f) The operator's seat 7 is disposed to project rearward from the swivel base 6.

(g) The base portion of the ground-work implement 9 supported by the implement support unit 37 is disposed at a position hither than the front and rear wheels 2, 3 and the engine 13.

(h) The fuel tank 16 and the working fluid tank 17 are distributed to the right and left on the lower structure 4.

(i) The lower structure 4 provides the vehicle frame 21 for suspending the front and rear wheels 2, 3.

(j) The cover 24 is provided for covering the upper face of the lower structure 4 and the front and rear wheels 2, 3 and for acting also as a weight and steps for the operator.

(k) The engine 13 is disposed at the raised portion 4B of the lower structure 4 and the power transmission mechanism 14 is disposed at the flat portion 4A of the lower structure 4.

(l) The hydrostatic transmission 26 is employed as the power transmission mechanism 14 and the input shaft 27 and the output shaft 28 of this transmission 26 are disposed substantially along the fore and aft direction and distributed on the right and left.

(m) Of the swivel base 6, its rear portion is disposed adjacent the engine 13 and its front portion is disposed to be overlapped in the fore and aft direction with the front wheels 2.

(n) The swivel base 6 has a substantially circular shape in the plan view.

(o) In the implement support unit 37, the swivel base 6 and the support member 38 mounted erect on this swivel base 6 together support the swing shaft 39 and this swing shaft 39 pivotally supports the swing member 40 which is pivoted by the swing cylinder 41. And, this swing member 40 pivotally supports, via the horizontal shaft 48, the broom 42 and the boom cylinder 43 for lifting this boom 42.

(p) The implement support unit 37 has a height designed to allow the passage of the boom 42 and the boom cylinder 3 above the highest position of the lower structure 4.

(q) The front upper portion of the swing member 40 is designed to project radially outward from the swivel base 6.

(r) On the swivel base 6, the operator's seat mounting frame 51 is mounted. And, the rear portion of this operator's seat mounting frame 51 is designed to project rearwards from the swivel base 6 and the operator's seat 7 is disposed on this rearward projecting portion so as to allow passage of the operator's seat 7 above the lower structure 4 during a swiveling movement of the swivel base 6.

(s) The operator's seat mounting frame 51 includes the ROMPS 53 having the right and left struts 52 mounted erect on the swivel base 6 and the support member 54 disposed between the lower portions of the right and left struts 52 of this ROMPS 53 and the swivel base 6. And, the operator's seat 7 is attached to the ROMPS 53 and/or the support member 54.

(t) The ground-work implement 9 includes the arm 44 attached to the leading end of the boom 42 and to the leading end of this arm 44, the implement 46 is attached. The leading end of this arm 44 is forked into two right and left parts for allowing exchange of various implements 46 of different widths.

(u) The forked leading end of the arm 44 provide the left and right arm portions 44L, 44R which are extendable and contractible relative to each other.

These features may be used in various combinations also when the basic construction of the wheeled work vehicle 1 is added with the further feature of e.g. setting the total weight of at least the swivel base 6, the operator's seat 7, and the steering unit 8 among the swivel base 6, the operator's seat 7, the steering unit 8 and the ground-work implement 9 to be less than the total weight of the lower structure 4 including the front and rear wheels, 2, 3 or the still further feature of limiting the distance L1 from the swivel shaft 5 to the rear end of the upper structure 11 within the distance L2 from the swivel shaft 5 and the rear wheel 3.

The above-described wheeled work vehicle 1 is suitable for effecting such works as a grading operation on an inclined ground or a limited space for which the skid steering loader is generally not suited. Although this vehicle can effect such work as collecting earth while moving about, the vehicle is good at such operation of collecting earth by the hydraulic power while the vehicle is parked still on the ground. And, with exchange of implements 46 having different widths, this single vehicle can effect both a transporting operation and a ditch digging operation for a depth less than 1.8 m such as for laying a wire under the ground.

That is to say, the grading operations using machinery are divided roughly into the transporting operation and the grading operation. And, this wheeled work vehicle 1 can effect with particularly high efficiency the grading operation which is a non-transporting, earth moving operation, such as for forming a slope or undulation on the ground surface or leveling the ground surface, or collecting the earth, backfilling a ditch or a hole, etc.

Incidentally, the invention is not limited to the foregoing embodiment, but may be varied in many ways. For instance, in place of the four-column type ROPS 53 employed in the foregoing embodiment, a two-column type ROMPS or a cabin unit may be mounted on the vehicle. Or, the manipulating units 55 may be disposed adjacent the steering wheel 73. Or, the stabilizer 10 may be attached to both the front and rear portions of the lower structure 4. Further, the drive wheels may be replaced by crawlers, while providing the driven wheels as wheels.

In these manners, the invention may be embodied in any other manner as described above. Further changes or modifications will be apparent for those skilled in the art from the foregoing disclosure within the scope of the invention defined in the appended claims.

What is claimed is:

1. A wheeled work vehicle comprising:

a lower structure supported on the ground by front wheels and rear wheels;

an engine mounted on the lower structure;

a swivel base mounted on the lower structure to be swivellable about a swivel shaft disposed between the front wheels and the rear wheels;

an operator's seat and an implement support unit which are mounted on the swivel base, and an implement supported to the implement support unit;

wherein the swivel base is disposed at a position lower than upper ends of the front wheels and rear wheels.

2. The wheeled work vehicle according to claim 1, wherein the engine is disposed between the front and rear wheels; and the swivel base is disposed at a position lower than an upper end of the engine.

3. The wheeled work vehicle according to claim 2, wherein the operator's seat is disposed to extend outwardly and upwardly from a periphery of the swivel base so as to be able to pass above the engine during a swiveling movement of the swivel base.

4. The wheeled work vehicle according to claim 3, wherein the implement support unit extends outwardly and upwardly from the periphery of the swivel base so as to be able to pass above the engine during 360 degrees swiveling movement of the swivel base.

5. The wheeled work vehicle according to claim 1, wherein the lower structure comprises a rectangular frame assembly having a front frame, a rear frame and a pair of right and left side frames, the rectangular frame assembly suspending the front and rear wheels therefrom, the rectangular frame assembly forming a space for disposing the engine.

6. The wheeled work vehicle according to claim 5, wherein the rectangular frame assembly mounts thereon a fuel tank on one outer side thereof and a working fluid tank on the other outer side thereof.

7. The wheeled work vehicle according to claim 1, wherein the lower structure includes a cover for covering the engine, a fuel tank, a working fluid tank all mounted on the lower structure, the cover acting also as a step for facilitating operator's getting on and off the vehicle.

8. The wheeled work vehicle according to claim 2, wherein a power transmission mechanism for transmitting power of the engine to drive wheels is disposed forwardly of the engine and downwardly of the swivel base.

9. The wheeled work vehicle according to claim 8, wherein said power transmission mechanism includes a hydrostatic transmission (HST) having an input shaft and an output shaft which are disposed on the left and right of the transmission and extend substantially along the fore-and-aft direction.

10. The wheeled work vehicle according to claim 1, wherein the swivel base has a substantially circular configuration in plan view.

11. The wheeled work vehicle according to claim 10, wherein a rear portion of the swivel base is adjacent the engine and a forward portion of the swivel base is overlapped with the front wheels.

12. The wheeled work vehicle according to claim 1, wherein the implement support unit includes a support member and a swing shaft which are provided on the swivel base, and a swing member which can pivot about the swing shaft by a swing cylinder; and the swing member projects outward from a swiveling path of the swivel base.

13. The wheeled work vehicle according to claim 1, wherein the swivel base mounts a ROPS (roll over protection system) comprised of pipes, a portion of the ROPS being overlapped with the swivel base.

14. The wheeled work vehicle according to claim 13, wherein the operator's seat is supported at least partially by the ROPS.

15. A wheeled work vehicle comprising:

a lower structure supported on the ground by front wheels and rear wheels;

an engine mounted on the lower structure;

a swivel base mounted on the lower structure to be swivellable about a swivel shaft disposed between the front wheels and the rear wheels;

an operator's seat and an implement support unit which are mounted on the swivel base, and an implement supported to the implement support unit;

wherein the swivel base is disposed adjacent the engine and the operator's seat mounted on the swivel base extends outwardly and upwardly from a periphery of the swivel base so as to be able to pass above the engine during a swiveling movement of the swivel base.

16. A wheeled work vehicle comprising:

a lower structure supported on the ground by front wheels and rear wheels;

an engine mounted on the lower structure;

a swivel base mounted on the lower structure to be swivellable about a swivel shaft disposed between the front wheels and the rear wheels;

an operator's seat and an implement support unit which are mounted on the swivel base, and an implement supported to the implement support unit;

wherein the swivel base is disposed adjacent the engine and lower than an upper end of the engine.

* * * * *